US007497138B2

(12) United States Patent
Kubinski et al.

(10) Patent No.: US 7,497,138 B2
(45) Date of Patent: Mar. 3, 2009

(54) SYSTEM AND METHOD FOR IMPROVING PERFORMANCE OF A FLUID SENSOR FOR AN INTERNAL COMBUSTION ENGINE

(75) Inventors: David Kubinski, Canton, MI (US); Garry Zawacki, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 405 days.

(21) Appl. No.: 11/308,325

(22) Filed: Mar. 16, 2006

(65) Prior Publication Data

US 2007/0214862 A1 Sep. 20, 2007

(51) Int. Cl.

| | |
|---|---|
| ***G01M 15/10*** | (2006.01) |
| ***G01N 33/00*** | (2006.01) |
| ***G01N 1/20*** | (2006.01) |
| ***G01N 1/22*** | (2006.01) |

(52) U.S. Cl. ..... 73/866.5; 73/23.31; 73/114.71

(58) Field of Classification Search ..... 73/1.06, 73/23.31, 31.07, 64.56, 114.71, 863.58–863.61, 73/863.81–863.82, 866.5

See application file for complete search history.

(56) References Cited

U.S. PATENT DOCUMENTS

| | | | | | |
|---|---|---|---|---|---|
| 3,473,388 | A | * | 10/1969 | Lynn | 73/863.58 X |
| 3,478,600 | A | * | 11/1969 | Lynn | 73/863.58 X |
| 4,018,089 | A | * | 4/1977 | Dzula et al. | 73/863.58 |
| 4,131,011 | A | * | 12/1978 | Ling | 73/863.61 X |
| 4,135,382 | A | * | 1/1979 | Capone | 73/31.05 |
| 4,534,213 | A | * | 8/1985 | Mirikidani | 73/114.71 |
| 5,251,470 | A | | 10/1993 | Lampe et al. | 73/31.05 |
| 5,450,749 | A | * | 9/1995 | Strom et al. | 73/114.72 |
| 5,711,863 | A | | 1/1998 | Henkelmann et al. | 204/428 |
| 5,834,657 | A | * | 11/1998 | Clawson et al. | 73/863.81 |
| 5,948,963 | A | | 9/1999 | Kato et al. | 73/23.2 |
| 5,955,656 | A | | 9/1999 | Graser et al. | 73/23.31 |
| 6,551,498 | B2 | | 4/2003 | Nelson | 205/784.5 |
| 6,637,254 | B2 | | 10/2003 | Wagner et al. | 73/31.05 |
| 6,723,286 | B2 | * | 4/2004 | Sakairi et al. | 422/62 |
| 7,024,950 | B2 | * | 4/2006 | Guldi et al. | 73/863.01 |
| 7,217,355 | B2 | * | 5/2007 | Nair et al. | 73/23.31 X |

(Continued)

FOREIGN PATENT DOCUMENTS

| | | | |
|---|---|---|---|
| DE | 3803352 | A1 * | 8/1989 |

(Continued)

OTHER PUBLICATIONS

Wingbrant, H. et al. "Using a MISiCFET device as a cold start sensor"; Sensors and Actuators, B93 (2003) pp. 295-303.

*Primary Examiner*—Thomas P Noland
(74) *Attorney, Agent, or Firm*—Julia Voutyras; Brooks Kushman P.C.

(57) ABSTRACT

A system and method for improving sensor performance of an on-board vehicle sensor, such as an exhaust gas sensor, while sensing a predetermined substance in a fluid flowing through a pipe include a structure for extending into the pipe and having at least one inlet for receiving fluid flowing through the pipe and at least one outlet generally opposite the at least one inlet, wherein the structure redirects substantially all fluid flowing from the at least one inlet to the sensor to provide a representative sample of the fluid to the sensor before returning the fluid through the at least one outlet.

13 Claims, 2 Drawing Sheets

U.S. PATENT DOCUMENTS

| | | | | |
|---|---|---|---|---|
| 2002/0110490 | A1 * | 8/2002 | Sakairi et al. | 422/68.1 |
| 2002/0166391 | A1 * | 11/2002 | Khan et al. | 73/863.61 |
| 2004/0149595 | A1 | 8/2004 | Moore | 205/784.5 |

FOREIGN PATENT DOCUMENTS

| | | | |
|---|---|---|---|
| DE | 4335655 | C1 * | 3/1995 |
| EP | 715167 | A2 * | 6/1996 |
| EP | 827713 | A1 * | 3/1998 |
| EP | 1586890 | A1 * | 10/2005 |
| GB | 2248197 | A * | 4/1992 |
| WO | WO 2005005964 | A1 * | 1/2005 |

* cited by examiner

SYSTEM AND METHOD FOR IMPROVING PERFORMANCE OF A FLUID SENSOR FOR AN INTERNAL COMBUSTION ENGINE

STATEMENT OF GOVERNMENT INTEREST

The U.S. Government may have a paid-up license in this invention and the right in limited circumstances to require the patent owner to license others on reasonable terms as provided for by the terms of Contract No. DE-FC26-01NT41103 awarded by The Department of Energy.

BACKGROUND OF THE INVENTION

1. Field of the Invention

The present invention relates to systems and methods for improving the performance of sensors used to monitor the exhaust of an internal combustion engine. These gas or fluid sensors include exhaust gas and soot sensors.

2. Background Art

Exhaust gas and other fluid sensors are used for both control and monitoring of internal combustion engines including vehicles powered by gasoline or diesel fuel and using various engine technologies, such as lean-burn, for example. Various types of gas or fluid sensors may include heated exhaust gas oxygen (HEGO) or lambda sensors, universal exhaust gas oxygen (UEGO) sensors, nitric oxide and nitrogen dioxide (NOx) sensors, ammonia (NH3) sensors and soot sensors, for example. These sensors provide information regarding the presence and/or concentrations of particular substances or compounds in the exhaust gas. This information is used by the engine and/or vehicle controller to monitor and/or control the engine.

The standard mounting location of an on-board vehicle exhaust gas sensor is at or near the wall of the exhaust pipe where the exhaust flow is more easily accessible and typically cooler than at the center of the exhaust pipe. As such, the sensor is exposed only to the exhaust gas in this limited region of the pipe, which for many applications is not problematic. However, the present inventors have recognized that the presence or concentration of the component measured by the sensor may not be uniformly distributed across the diameter of the exhaust pipe for some applications or operating conditions. For example, in applications employing a urea/SCR after-treatment system, an ammonia (NH3) sensor may be desirable to detect ammonia (NH3) desorbed or released by the SCR catalyst, the amount of which is very sensitive to the exhaust gas temperature, which is generally higher in the center of the exhaust flow. The present inventors have observed that the concentration of ammonia in the center of a four-inch exhaust pipe may be in certain circumstances from 10 to 100 times greater than it is at the pipe wall where the sensor is traditionally mounted such that the exhaust flow at the pipe perimeter is not necessarily representative of the content of ammonia in the bulk flow. Similarly, for diesel applications using a soot sensor positioned downstream of a particulate filter, soot generated by a crack in the filter, for example, may produce a localized, non-uniform soot distribution difficult to detect using a perimeter mounted sensor.

Laboratory equipment used to analyze exhaust flow often includes a sampling probe with multiple inlets that extends into the exhaust pipe or tube and extracts a sample using a vacuum pump for subsequent analysis. While this approach works well for research and development efforts, the additional complexity, cost, and packaging requirements are not amenable to real-time or near real-time sensing of exhaust flow on-board a vehicle.

Various types of on-board exhaust sensors include a protective tube or shield that surrounds the sensing element to protect or shield it from the harsh environment of the exhaust flow, such as described in U.S. Pat. Nos. 6,637,254 and 6,551,498, for example. Such devices generally allow only a small portion of the exhaust to pass over the sensing element to protect the sensing element while detecting the desired substance in the bulk flow. To protect the sensing element from high exhaust gas temperatures, the sensing element may be positioned some distance away from the exhaust flow as generally described in "Using a MISiCFET device as a cold start sensor" by H. Wingbrant et al., *Sensors and Actuators*, B93 (2003), pp. 295-303, for example.

SUMMARY OF THE INVENTION

A system and method for improving sensor performance while sensing a predetermined component of a fluid flowing through a pipe include a closed-ended structure for extending into the exhaust pipe and having at least one inlet for receiving fluid flowing through the pipe and at least one outlet generally opposite the at least one inlet relative to the direction of fluid flow, wherein the structure passively redirects substantially all fluid flowing from the at least one inlet to the at least one outlet toward the sensor to provide a representative sample of the bulk fluid to the sensor.

In one embodiment, the structure includes a closed end tube for extending about half way across an exhaust pipe associated with an internal combustion engine. The closed end tube includes at least one inlet for receiving exhaust gas and passively redirects the exhaust gas toward a sensor, which may include an integrated protective shield partially extending into an open end of the closed end tube, before being returned to the exhaust pipe through at least one outlet. In another embodiment, a tube or similar structure redirects exhaust gas outside of the exhaust pipe before flowing past an installed sensor to provide cooling of the exhaust gas before reaching the sensor.

One embodiment of a method for improving sensor performance according to the present invention includes passively redirecting fluid flowing through a representative cross-section of a pipe toward a sensor to provide a representative sample of the fluid to the sensor.

The present invention provides a number of advantages. For example, the present invention provides a sensor boss that can be used with currently available sensors to improve sensor performance by redirecting a representative cross-section of fluid flowing through a pipe toward the sensor. Providing a boss independent of the sensor also allows a common sensor to be used in applications having different flow profiles or exhaust pipe diameters. The present invention may be used to provide passive cooling of the exhaust gas or other fluid prior to reaching an associated sensor. The present invention does not require a device to extract the exhaust sample, such as a vacuum pump. Improved sensor performance associated with the present invention may result in improved emissions control and fuel economy.

The above advantages and other advantages and features of the present invention will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the present invention as illustrated and described with reference to any one of the Figures may be combined with features illustrated in one or more other Figures to produce embodiments of the present invention that are not explicitly illustrated or described. The combinations of features illustrated provide representative embodiments for typical applications. However, various combinations and modifications of the features consistent with the teachings of the present invention may be desired for particular applications or implementations.

Figure 1:
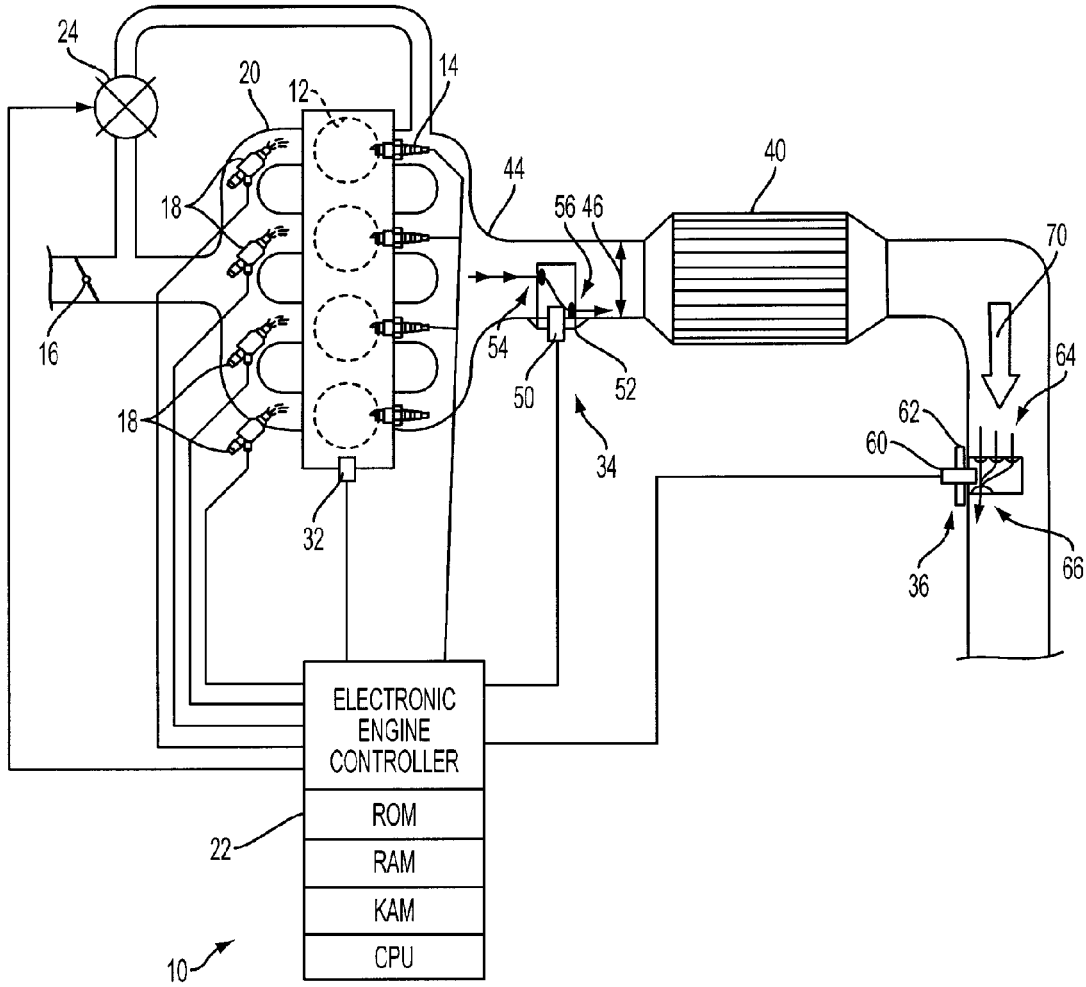
FIG. 1 is a block diagram illustrating a representative application for a system or method for improving performance of a sensor according to the present invention.

FIG. 1 is a block diagram illustrating operation of system or method for improving sensor performance according to the present invention. As shown in FIG. 1, system 10 includes an internal combustion engine having a plurality of cylinders 12. For spark-ignited engine applications, each cylinder 12 may have an associated spark plug 14. Those of ordinary skill in the art will recognize that the present invention is independent of the particular engine technology or fuel and may be applied to various types of internal combustion engine applications including but not limited to diesel fuel compression ignition engines. A plurality of fuel injectors 18 provides fuel in one or more injections to cylinders 12 with the fuel being mixed with air and EGR in some applications, which may be controlled by a throttle plate or valve 16 and EGR valve 24, respectively. EGR valve 24, fuel injectors 18, and preferably, throttle valve 16 are all operated by electronic engine/vehicle/powertrain controller 22. As known to those skilled in the art, controller 22 generally includes a processor (CPU), input/output ports, and one or more types of computer readable storage media for storing executable instructions and calibration values generally represented by the illustrated read-only memory (ROM), random-access memory (RAM), and keep-alive memory (KAM). Controller 22 receives signals from a plurality of sensors generally represented by sensors or sensor assemblies 32, 34, and 36 coupled to engine 10 and controls fuel supplied by injectors 18, EGR flow controlled by valve 24, and engine airflow controlled by throttle valve 16.

In the representative application illustrated in FIG. 1, sensor assembly 34 includes a first embodiment of a device for improving sensor performance according to the present invention and is positioned upstream of an exhaust treatment or after-treatment device 40, which generally represents any of a number of known devices/systems that may be used alone or in combination in various applications, such as three-way catalysts (TWC), lean NOx traps (LNT), urea/SCR (selective catalytic reactor or reduction converter) systems, particulate filters, and the like. As such, sensor assembly 34 may include a sensor 50 for detecting presence or concentration of one or more elements or substances in the bulk exhaust flow passing through exhaust pipe or tube 44 from the internal combustion engine. Representative sensors may include HEGO, UEGO, soot, ammonia, and NOx sensors, for example. Sensor 50 is mounted in an open end of a sensor boss 52 that extends into exhaust pipe 44 a distance based on the expected radial flow profile of the target substance or element to be detected by sensor 50. For detectable substances that may have a temperature dependent distribution, boss 52 preferably extends about half the distance across (diameter) 46 of exhaust pipe 44 because the exhaust temperature is generally higher in the central portion of exhaust pipe 44. Sensor boss 52 includes a closed ended tube or similar structure having at least one inlet oriented upstream and positioned to receive exhaust gas from a central portion of exhaust pipe 44 and at least one outlet 56 oriented generally opposite inlet 54. Outlet 56 is positioned such that substantially all exhaust gas flowing through inlet 54 flows toward sensor 50 before exiting boss 52 through outlet 56.

Sensor assembly 36 includes a second embodiment of a device for improving sensor performance according to the present invention and is positioned downstream of exhaust treatment or after-treatment device 40. Sensor 60 is mounted within sensor boss 62 that includes a structure extending into exhaust pipe 44 having a plurality of inlets 64 for receiving exhaust gas from bulk flow 70 and passively redirecting exhaust gas passing through inlets 64 to an outlet 66. As illustrated in FIG. 1, inlets 64 are generally positioned facing upstream with outlet 66 positioned generally opposite inlets 64 so that substantially all of the exhaust gas flowing through the structure flows toward sensor 60 to provide a representative sample or cross-section of bulk flow 70 flowing through pipe 44. The structure extending into the exhaust pipe 44 has a length sufficient to position at least one inlet 64 at a desired sampling location. For detectable substances such as ammonia that may have a temperature dependent distribution across a section of exhaust pipe 44, the desired sampling location for at least one inlet 64 is about half the distance across the pipe.

Figure 2:
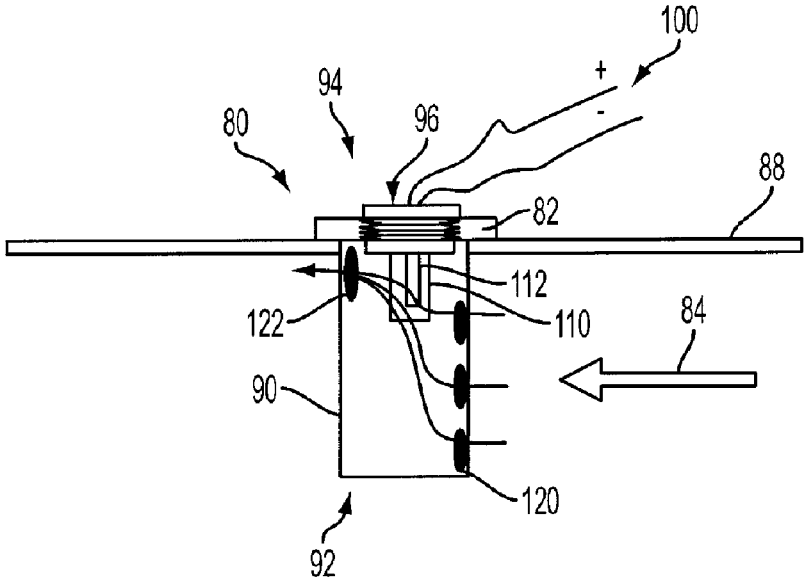
FIG. 2 illustrates one embodiment of a device for improving sensor performance according to the present invention.

Referring now to FIG. 2, one embodiment of a system or method for improving performance of an on-board vehicle sensor according to the present invention is shown. System 80 includes a sensor boss 82 that extends into the flow path 84 of a fluid, such as exhaust gas, flowing from an upstream location toward a downstream location. Sensor boss 82 may be permanently secured to the periphery or wall 88 of a pipe or tube that contains the fluid by an adhesive or by welding, for example. Alternatively, boss 82 may be secured by a twist-lock, threads, press fit, etc. Boss 82 includes a tube or similar structure 90 having a closed end 92 extending into the exhaust or other pipe 88, and an open end 94 adapted to receive a sensor 96. In the illustrated embodiment, open end 94 is threaded to engage corresponding threads of sensor 96. Other arrangements for securing and orienting (if necessary) sensor 96 within boss 82 may be provided depending upon the particular application and implementation. One or more wires or leads 100 may be used to provide a signal from sensor 96 to an associated sensor signal processor and/or engine/vehicle controller or monitor. Sensor 96 may include a protective sleeve or shield 110 that surrounds a sensing element 112, although the present invention is independent of the particular sensor construction.

Structure 90 of boss 82 includes at least one inlet 120 and outlet 122. Inlets 120 may be evenly spaced along the length of structure or tube 90, or may be arranged based on a desired sampling profile similar to that shown with respect to the embodiment of FIG. 3. Likewise, the shape and size of inlet(s) 120 may be selected to provide a desired sample distribution based on the type of sensor 96 and expected distribution of target species across the diameter of pipe 88. Exhaust gas flowing through pipe 88 enters inlet(s) 120 and is passively redirected by structure 90 and appropriate positioning of outlet 122 so that substantially all the gas flows toward sensor 96 to provide a gas sample or mixture from one or more target sampling areas, such as the central portion of pipe or tube 88.

Structure 90 of sensor boss 82 may have any desired geometry selected to provide a sample from a target area of pipe 88. For example, structure 90 may be implemented by a round, square, rectangular, or other shape tube that may have a uniform cross-section or a cross-section that varies, such as a cone to provide a desired passive flow characteristic for the sampled fluid/gas between inlet(s) 120 and outlet 122 such that the sample is redirected toward sensor 96 and does not stagnate within structure 90. Similarly, to provide a suitable flow of sample fluid toward sensor 96, the area of outlet 122 should be greater than or equal to the cumulative area of inlet(s) 120.

Figure 3:
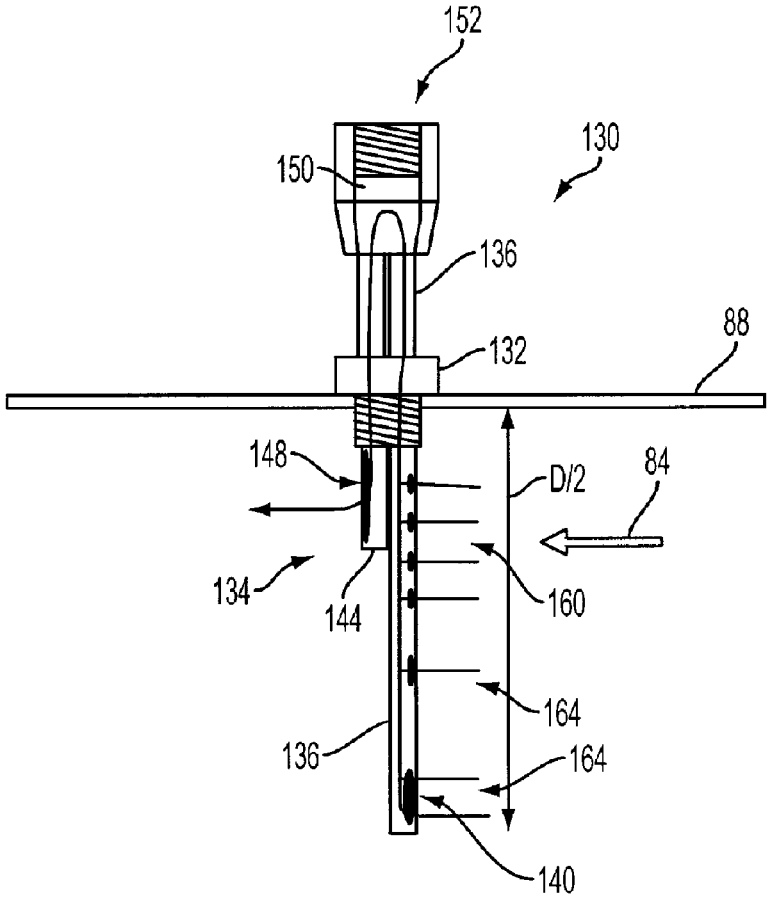
FIG. 3 illustrates another embodiment of a device for improving sensor performance according to the present invention.

Another embodiment of a system/method for improving sensor performance of an on-board vehicle sensor according to the present invention is illustrated in FIG. 3. System 130 includes a sensor boss 132 having a structure 134 that includes a first closed end tube 136 having at least one inlet 140 and a second closed end tube 144 having at least one outlet 148. Closed end tubes 136, 144 are fluidly coupled by a sensing chamber 150 coupled to an open end of the tubes and spaced from pipe 88. Sensing chamber 150 includes an opening 152 adapted to receive a sensor that fluidly seals chamber 150 when installed. In this embodiment, exhaust gas or other fluid flows through inlet(s) 140 and is passively routed or redirected within first tube 136 outside of pipe 88 to provide cooling of the sample before reaching sensing chamber 150 and returning to pipe 88 via outlet 148. As those of ordinary skill in the art will appreciate, system 130 may also be implemented by a structure having a divided tube with an inlet portion separated from an outlet portion by a divider that extends from the closed end of the inlet portion to the sensing chamber rather than discrete or distinct tubes coupled by the sensing chamber.

In the embodiment illustrated in FIG. 3, structure 134 includes a plurality of inlets 140 that include a first group of inlets 160 uniformly spaced and having substantially equal openings, a second inlet 162 (or group of inlets) having a somewhat larger opening and spaced apart from inlets 160, and a third inlet 164 having a larger opening and positioned within a central region of flow 84. The size, number, and position of inlets 140 may be selected to "tune" the sample provided by sensor boss 132 to an associated sensor based on an expected radial distribution of one or more target species to be detected by the sensor by provided varying amounts of sample gas corresponding to the inlet opening area in a particular region of pipe 88.

As those of ordinary skill in the art will understand based on the representative embodiments illustrated and described with reference to FIGS. 1-3, one embodiment of a method for improving sensor performance of an exhaust gas or other type of fluid sensor for on-board vehicle applications according to the present invention includes passively redirecting fluid from a target region of a fluid flow toward a corresponding sensor. A sensor boss having a closed end tube with one or more upstream inlets and an oppositely positioned outlet may be used to passively redirect flow from a central region of an exhaust pipe toward a sensor mounted on the periphery of the exhaust pipe. Depending on the particular application, the method may include redirecting fluid from the inlet(s) outside of the exhaust pipe but contained by the sensor boss to a sensing chamber adapted for mounting a sensor to provide cooling of the exhaust gas before reaching the sensor. Positioning and size of the inlet(s) may be determined based on an expected radial distribution profile of a target substance to be detected by the sensor.

Prototype testing of one embodiment of the present invention included an exhaust sensor boss with three inlet holes and one outlet hole with an installed ammonia sensor in a diesel engine having a urea/SCR exhaust after-treatment device. The prototype boss extending about ¾ the distance across a four-inch exhaust pipe with the first inlet at about ½ the distance (about two inches) across the exhaust pipe. To establish a reference reading, the sensor was first positioned in the exhaust flow near the wall of the exhaust pipe and downstream of the SCR device without using a sensor boss according to the present invention. The ammonia concentration in the exhaust detected by the sensor was then compared to concentration measured with a FTIR spectrometer, which sampled gas (pulling it via an external vacuum pump) from a tube with multiple inlets across the pipe radius. The FTIR results showed concentrations as high as 300 ppm that were not detected by the sensor. The sensor was then installed in a sensor boss according to the present invention that was positioned at the same location downstream of the SCR device with the results of the sensor reading again compared to the ammonia concentration indicated by the FTIR spectrometer. Using the system/method of the present invention, the sensor readings were very well correlated with the ammonia concentrations indicated by the FTIR spectrometer.

As previously described, the present invention may be used in a variety of on-board sensing applications with various types of sensors. The invention is expected to be particularly useful in applications that exhibit non-uniform radial distribution of target species, including urea/SCR after-treatment applications having an ammonia and/or NOx sensor and applications employing a particulate filter with a soot sensor.

As such, the present invention provides a system and method for improving sensor performance that include a sensor boss adapted to receive a sensor and redirect a representative cross-section of exhaust gas or other fluid flowing through a pipe toward the sensor. Providing a boss independent of the sensor allows a common sensor to be used in across multiple applications having different flow profiles or exhaust pipe diameters. The present invention may be used to provide passive cooling of the exhaust gas or other fluid prior to reaching an associated sensor. The present invention does not require a device to extract the exhaust sample, such as a vacuum pump, but uses passive selection and redirection of a target fluid flow. Improved sensor performance associated with the present invention may result in improved emissions control and/or fuel economy.

While the best mode for carrying out the invention has been described in detail, those familiar with the art to which this invention relates will recognize various alternative designs and embodiments for practicing the invention as defined by the following claims.

What is claimed is:

1. A device adapted for receiving a sensor for sensing a specified substance in a fluid flowing through a pipe, the device comprising:

a structure having a closed end for extending into the pipe and having at least one inlet for receiving fluid flowing through the pipe and at least one outlet generally opposite the at least one inlet wherein the structure separates the at least one inlet from the at least one outlet to redirect substantially all fluid flowing from the at least one inlet outside the pipe but within the structure over the sensor and to the at least one outlet to provide a representative sample of the fluid to the sensor.

2. A device adapted for receiving a sensor for sensing a specified substance in a fluid flowing through a pipe, the device comprising:

a structure for extending into the pipe and having at least one inlet for receiving fluid flowing through the pipe and at least one outlet generally opposite the at least one inlet wherein the structure redirects substantially all fluid flowing from the at least one inlet to the at least one outlet over the sensor to provide a representative sample of the fluid to the sensor; and wherein the structure comprises:

a first closed end tube having at least one inlet;

a second closed end tube having at least one outlet; and a sensing chamber in fluid communication with an open end of the first and second closed end tubes, the sensing chamber adapted to receive the sensor, which is spaced from the pipe when installed, to cool the fluid before flowing over the sensor.

3. The device of claim 2 wherein the first closed end tube extends at least half way across the pipe when installed.

4. The device of claim 2 wherein the first closed end tube includes a plurality of inlets positioned upstream in the pipe when installed and wherein the second closed end tube includes an outlet positioned generally downstream in the pipe when installed.

5. The device of claim 4 wherein cumulative area of the plurality of inlets is not greater than area of the outlet.

6. The device of claim 2 further comprising a sensor disposed within the structure for sensing the specified substance in the fluid.

7. The device of claim 2 wherein the structure comprises a plurality of inlets substantially equally spaced along a portion of the structure extending at least half way across the pipe when installed.

8. A system for improving performance of an exhaust gas sensor in a vehicle having an internal combustion engine connected to an exhaust pipe, the system comprising:

a sensor boss having an open end adapted for receiving a sensor and a closed end extending into the exhaust pipe, the sensor boss including an inlet portion having a closed end with at least one upstream oriented opening about half way across the exhaust pipe positioned to receive exhaust gas from a central portion of the exhaust pipe, and an outlet portion having a closed end with at least one downstream oriented opening, wherein exhaust gas flows within the inlet portion outside the exhaust pipe before returning to the exhaust pipe through the outlet portion and at least one outlet is positioned such that substantially all exhaust gas flowing through the inlet portion flows toward the sensor before exiting the sensor boss through the at least one outlet.

9. The system of claim 8 further comprising:

an exhaust gas sensor disposed within the open end of the sensor boss.

10. The system of claim 9 wherein the exhaust gas sensor is permanently secured to the sensor boss and wherein the sensor boss is removably secured to the exhaust pipe.

11. The system of claim 8 wherein the sensor boss is removably secured to the exhaust pipe.

12. The system of claim 8 wherein the sensor boss comprises an inlet portion having a plurality of openings substantially equally spaced and extending about half way across the exhaust pipe.

13. The system of claim 8 further comprising a sensor positioned in the open end of the sensor boss and spaced from the exhaust pipe.

* * * * *